US009506610B2

(12) United States Patent
Han

(10) Patent No.: US 9,506,610 B2
(45) Date of Patent: Nov. 29, 2016

(54) SINGLE-LINE STRING LAMP

(71) Applicant: Houhua Han, Suizhou (CN)

(72) Inventor: Houhua Han, Suizhou (CN)

( * ) Notice: Subject to any disclaimer, the term of this patent is extended or adjusted under 35 U.S.C. 154(b) by 0 days.

(21) Appl. No.: 14/720,541

(22) Filed: May 22, 2015

(65) Prior Publication Data

US 2015/0338036 A1 Nov. 26, 2015

(30) Foreign Application Priority Data

May 23, 2014 (CN) ..... 2014 2 0266522 U

(51) Int. Cl.

| | |
|---|---|
| ***F21S 4/00*** | (2016.01) |
| ***F21V 23/00*** | (2015.01) |
| *F21W 121/04* | (2006.01) |
| *F21W 121/00* | (2006.01) |
| *F21W 131/10* | (2006.01) |
| *H01R 13/58* | (2006.01) |

(52) U.S. Cl.

CPC ..... *F21S 4/001* (2013.01); *F21S 4/10* (2016.01); *F21V 23/002* (2013.01); *F21W 2121/00* (2013.01); *F21W 2121/04* (2013.01); *F21W 2131/10* (2013.01); *H01R 13/5816* (2013.01)

(58) Field of Classification Search

CPC ..... F21S 4/001; F21S 4/10; F21V 23/001; F21V 23/002

See application file for complete search history.

(56) References Cited

U.S. PATENT DOCUMENTS

2015/0078000 A1* 3/2015 Chen ..... F21S 4/002 362/249.16

FOREIGN PATENT DOCUMENTS

CN 203549524 4/2014

* cited by examiner

*Primary Examiner* — Thomas M Sember

(57) ABSTRACT

The present invention relates to a single-line string lamp, comprising a plurality of lamp bodies connected in series and a plurality of lead wire segments used for connecting two adjacent lamp bodies or connecting the lamp bodies with power connectors, wherein a conductive element is fixed at the end, which is connected with the corresponding lamp body, of each lead wire segment, and each lamp body comprises a lamp bulb, a lamp holder and a hollow connecting base. The anti-tensile strength of each lead wire segment is enhanced by mixing a plastic wire or a metal wire different from a copper material in a conductive copper wire strand of each lead wire segment, thickening each lead wire segment, or adding a plastic coating and the like, and a fixed part is fixed at a position on each lead wire segment close to the conductive element, therefore, when the lead wire segment is subjected to an outward tensile force relative to the connecting base, the relative positional stability between the conductive element and the inner wall of the connecting base can be maintained by the fixed part and each lead wire segment, so that the conductive element cannot be disengaged from an opening in the bottom of the connecting base, and the normal operation of the string lamp can be ensured. Thus, only one lead wire segment is required to connect the lamp bodies, thereby eliminating the need for a false line to bear most of a lateral tensile force.

17 Claims, 10 Drawing Sheets

SINGLE-LINE STRING LAMP

TECHNICAL FIELD

The present invention relates to a decorative string lamp, and particularly to a string lamp using a single line.

BACKGROUND

The string lamp is widely used for indoor or outdoor decoration as a requisite ornament in festival celebration. The string lamp mainly refers to decorative lamps connected in series in an electrical circuit, and typically has an elongated lamp bulb, a lamp holder for fixing the lamp bulb, and a connecting base for achieving electrical connection between the lamp bulb and a lead wire. A plurality of string lamps are connected with one another in series through lead wire segments with metal conductive terminals fixed at two ends. The conductive terminals of these lead wire segments are inserted into the connecting base from the bottom of the connecting base to be in electrical connection with lamp pins of the lamp bulb. Wherein, the principle of the string lamp is disclosed in the Chinese invention patent No. CN201320549905.5, filed on Sep. 5, 2013, as described above.

However, during the use of the string lamp with this structure for decoration, when a lead wire is subjected to lateral tension relative to the connecting base of the string lamp (the lead wire segment between the adjacent lamp holders is straightened perpendicular to an optical axis), some of the conductive terminals are inclined in the connecting base due to the tension, and finally likely to be pulled out from the bottom of the connecting base, resulting in potential safety hazards or extinguishment and failure of the string lamp, which also does not meet the requirements of American safety regulations.

To overcome this disadvantage, a decorative lamp manufacturer adds a false line on the string lamp, and the false line 81 and the lead wire segment 82 are stranded together, as shown in FIG. 1. In this way, under normal circumstances, when an electrical line is subjected to lateral tension, the false line can bear most of a tensile force, and the stress on the end of the lead wire segment and the conductive terminals is very low, so that their positions relative to the inner wall of the connecting base are unlikely to change, and they are unlikely to be pulled out from the bottom of the connecting base. Thus, commercially available string lamps used on Christmas trees in America are all in the form of double-line stranding. However, if the false line and the lead wire segment are not tightly stranded or copper sheets on the conductive terminals are obliquely embedded into the connecting base, when the electrical line is subjected to tension, some of the conductive terminals can also be pulled out, resulting in potential safety hazards. In addition, in this way, machining and manufacturing processes become complicated, the product cost becomes high, the quality is inconsistent, and manpower and material resources are wasted.

SUMMARY OF THE INVENTION

The objective of the present invention is to provide a single-line string lamp which uses a single line and achieves the effect that conductive terminals are unlikely to be disengaged from a connecting base when an electrical line is subjected to lateral tension.

In order to solve the above technical problems, the technical scheme adopted by the present invention is as follows: a single-line string lamp is provided, and the single-line string lamp comprises a plurality of lamp bodies connected in series and a plurality of lead wire segments used for connecting two adjacent lamp bodies or connecting the lamp bodies with power connectors; a conductive element is fixed at the end, which is connected with the corresponding lamp body, of each lead wire segment; each lamp body comprises: a lamp bulb, a lamp holder and a hollow connecting base. Wherein, at least two lamp pins extend out of the lower end of the lamp bulb; the lamp holder comprises a containing part used for containing the lower portion of the lamp bulb, and line holes for the at least two lamp pins to extend out of the bottom of the lamp holder are formed in the edge of the bottom of the containing part; the connecting base is used for containing the lamp holder, an opening for the conductive element to enter is formed in the bottom of the connecting base, the edge, in which the opening is formed, is provided with a clamping platform for preventing the conductive element from being disengaged after the conductive element enters the opening, and the conductive element is in electrical contact with the corresponding lamp pin;

each lead wire segment is provided with a lead wire reinforcing object used for enhancing its anti-tensile strength, or a connecting lead wire with enhanced anti-tensile strength is adopted in each lead wire segment. In one embodiment, an electrical line used in the lead wire segment is an electrical line internally provided with at least one wire made from plastic materials or fiber filament.

In one embodiment, the thickness of a plastic coating of each lead wire segment is 0.2-2 mm greater than the thickness of a standard electrical line with a diameter of 2.35 mm in the U.S. standard.

In one embodiment, a metal wire different from a copper material is mixed in a conductive copper wire strand of each lead wire segment.

Preferably, a plastic strip which extends along the side wall of the corresponding plastic coating integrally extends out of the outer side wall of the plastic coating of each lead wire segment, and one end of each conductive element is tightly held outside the plastic coating of the corresponding lead wire segment and the plastic strip.

In one embodiment, the connecting lead wire used in each lead wire segment is a UL conventional electrical line No. 22 or No. 20.

In one embodiment, the connecting lead wire used in each lead wire segment is a non-conventional electrical line with a diameter of 2.0-3.0 mm.

Furthermore, further optionally, a fixed part is fixed at a position on each lead wire segment close to the corresponding conductive element, and when each lead wire segment is subjected to an outward tensile force relative to each corresponding connecting base, the relative positional stability between the corresponding conductive element and the inner wall of the corresponding connecting base is maintained by each fixed part.

In one embodiment, each lamp body is connected with two lead wire segments, the fixed part comprises a plastic part, and the plastic part is tightly fixed at a position on the two lead wire segments close to the conductive element, so as to fix the two lead wire segments together; and the plastic part is one of: a complete plastic sleeve, a plastic sleeve with a gap, and two plastic sheets with central portions being connected together.

Preferably, when the plastic part is the complete plastic sleeve, a recess facing a gap between the two lead wire segments is formed in a position on the plastic part opposite to the gap, so as to tightly clamp the two lead wire segments; when the plastic part is the plastic sleeve with a gap, the gap is opposite to the gap between the two lead wire segments, and a recess is formed to tightly clamp the two lead wire segments; and when the plastic part is the two plastic sheets with central portions being connected together, two ends of the two plastic sheets are bent towards the lead wire segments to tightly clamp the two lead wire segments.

In one embodiment, each lamp body is connected with two lead wire segments, and the fixed part comprises a metal part and a plastic part sleeved on the metal part; the fixed part is fixed at a position on the two lead wire segments close to the conductive element; the metal part and the plastic part are one of: (1) a complete metal sleeve and a complete plastic sleeve sleeved on the metal sleeve, (2) a metal sleeve with a gap and a plastic sleeve with a gap sleeved on the metal sleeve, and (3) two metal sheets or plastic sheets with central portions being connected together; when the fixed part is the complete metal sleeve and the complete plastic sleeve sleeved on the metal sleeve, a recess facing a gap between the lead wire segments is formed in a position on the metal sleeve and the plastic sleeve opposite to the gap between the two lead wire segments, so as to tightly clamp the two lead wire segments; when the fixed part is the metal sleeve with a gap and the plastic sleeve with a gap sleeved on the metal sleeve, the gap in the metal sleeve and the plastic sleeve is opposite to the gap between the two lead wire segments, and a recess is formed to tightly clamp the two lead wire segments; and when the fixed part is the two metal sheets or plastic sheets with central portions being connected together, two ends of the two metal sheets are bent towards the lead wire segments to tightly clamp the two lead wire segments.

In one embodiment, each lamp body is connected with at least two lead wire segments, the fixed part comprises a hot-melt plastic sleeve, and the hot-melt plastic sleeve is tightly sleeved at a position on the two lead wire segments close to the conductive element.

The above fixed part is arranged at one of the following two positions: (1) the fixed part is arranged in the connecting base, and props against the clamping platform; and (2) the fixed part is arranged outside an opening of the connecting base, and is close to the opening of the connecting base.

In one embodiment, the fixed part comprises a complete metal sleeve or a metal sleeve with a gap sleeved on each lead wire segment, or comprises a U-shaped metal sheet clamped on each lead wire segment, and the fixed part is arranged in the connecting base, props against the clamping platform, and is close to the corresponding conductive element.

In one embodiment, the fixed part is an extension part, which extends towards the top of the connecting base for at least 4 mm, of the clamping platform, the extension part is connected with the inner wall of the connecting base, and the bottom of the conductive element props against the top of the extension part.

In one embodiment, the fixed part is glue filled between the lead wire segment extending into the connecting base and the inner wall of the connecting base, the height of the glue in a direction from the bottom of the connecting base to the top of the connecting base is at least 4 mm, and the bottom of the conductive element props against the top of the fixed part.

In one embodiment, the fixed part is a plastic part which is inserted into the gap between the lead wire segments from the opening in the bottom of the connecting base, the lead wire segments are tightly extruded towards the side wall of the connecting base by the plastic part, the bottom of the conductive element is close to the top of the plastic part, and the height of the plastic part in a direction from the bottom of the connecting base to the top of the connecting base is at least 3 mm.

The present invention further provides a single-line string lamp, wherein, in the technical scheme, the single-line string lamp is distributed on Christmas trees, Christmas canes or Christmas wreath branches and leaves.

The present invention also provides a single-line string lamp, in the technical scheme, the electrical line used in the lead wire segment connected on each lamp body is fixed on the corresponding branch and leaf or bracket respectively by means of winding or clamping with plastics.

Compared with the prior art, the single-line string lamp provided by the present invention has the following beneficial effects: according to the present invention, the anti-tensile strength of each lead wire segment can be enhanced by arranging a lead wire reinforcing object on each lead wire segment, such as mixing a plastic wire or a metal wire different from a copper material in a conductive copper wire strand of each lead wire segment, or adopting a connecting lead wire with enhanced anti-tensile strength in each lead wire segment, such as thickening each lead wire segment or adding a plastic coating and the like; in addition, to further enhance the anti-tensile strength of each lead wire segment, for the single-line string lamp provided by the present invention, a fixed part can also be fixed at a position on each lead wire segment close to the conductive element, so that no or only a very small force is transferred to the conductive element when each lead wire segment is subjected to an outward tensile force relative to the connecting base, especially a lateral tensile force, therefore, the position of the conductive element relative to the inner side wall of its connecting base cannot change or only changes very slightly, so that the conductive element cannot be disengaged from an opening in the bottom of the connecting base, and the normal operation of the string lamp can be ensured. Thus, only one lead wire segment is required to connect the lamp bodies, thereby eliminating the need for a false line to bear most of a lateral tensile force.

DETAILED DESCRIPTION

In order to further clarify the technical problems to be solved, the technical scheme and advantages of the present invention, a more particular description of the present invention will be rendered with reference to the accompanying drawings and embodiments. It is to be understood that the specific embodiments described herein are solely for purposes of illustrating the present invention and are not intended as a definition of the limits of the present invention.

The following is a further description of a single-line string lamp disclosed in the present invention with reference to particular embodiments and accompanying drawings.

Figure 1:
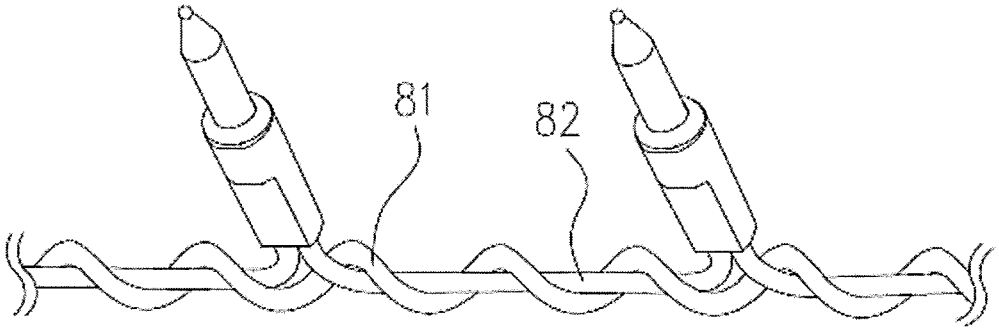
FIG. 1 is a structural schematic diagram of an existing string lamp, in which a connecting form of stranding a lead wire segment and a false line is adopted.
Figure 2:
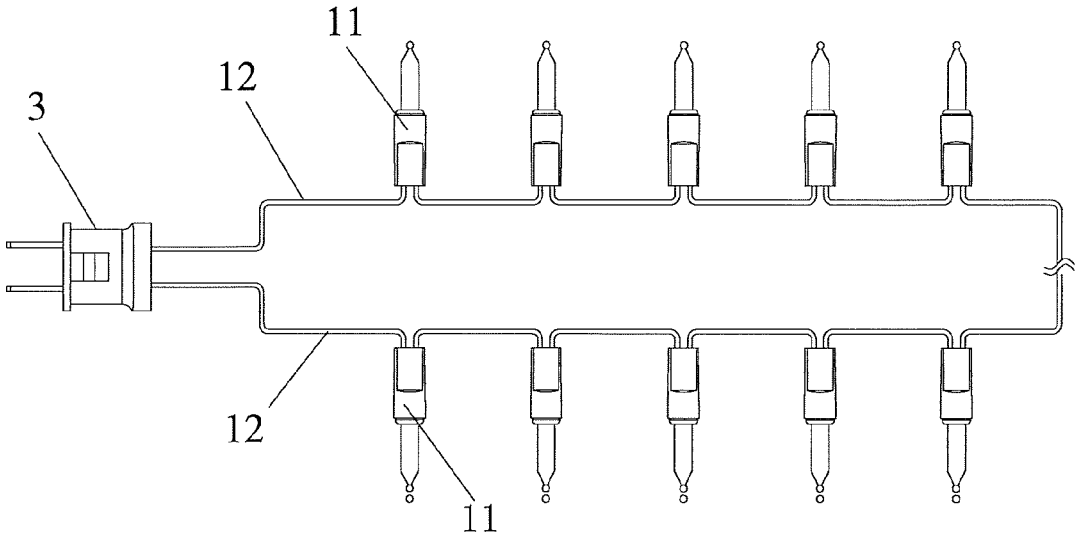
FIG. 2 is an overall structural schematic diagram of a single-line string lamp in one embodiment of the present invention.

The single-line string lamp of the present invention mainly comprises a plurality of lamp bodies connected in series and a plurality of lead wire segments used for connecting two adjacent lamp bodies or connecting the lamp bodies with power connectors, and may also comprise a power module. Wherein, as shown in FIG. 2, in the present invention, each single-line string lamp is provided with a power plug 3 for an external power source, and the power plug 3 is connected with the leading portion and the trailing portion of the single-line string lamp respectively, so as to supply power to the single-line string lamp. It can be seen clearly, every two lamp bodies are connected by only one lead wire segment, without arranging a false line to form a double-stranded line. A conductive element is fixed at the end of the lead wire segment that is connected with the lamp body, that is to say, a conductive element is fixed at either end of each lead wire segment connected between two lamp bodies. And for the lead wire segment that connects the lamp body and the power connector, only the end connected to the lamp body is provided with a conductive element.

The specific shape of the conductive element as well as a fixing form of the conductive element and the lead wire can be found with reference to the Chinese patent No. CN201320549905.5, filed on Sep. 5, 2013 or the Chinese patent No. CN201320449870.8, filed on Jul. 26, 2013.

Figure 12:
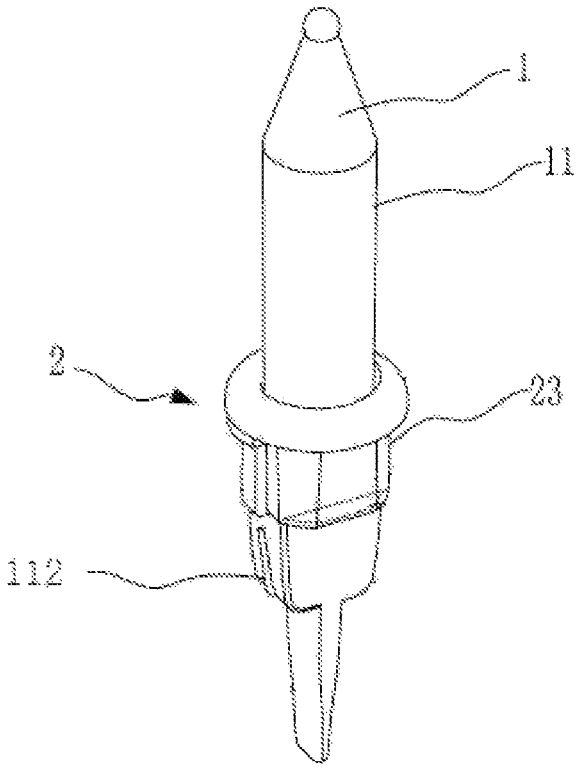
Fig. 12 (Prior art)
FIG. 12 is a perspective view of a lamp bulb and a lamp holder of a conventional string lamp.
Figure 13:
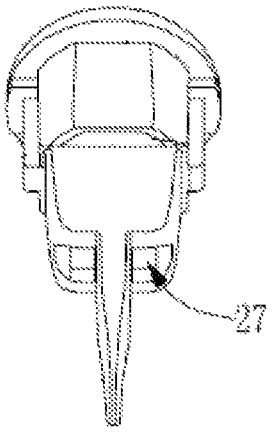
Fig. 13 (Prior art)
FIG. 13 is another perspective view of a lamp holder of the conventional string lamp.
Figure 14:
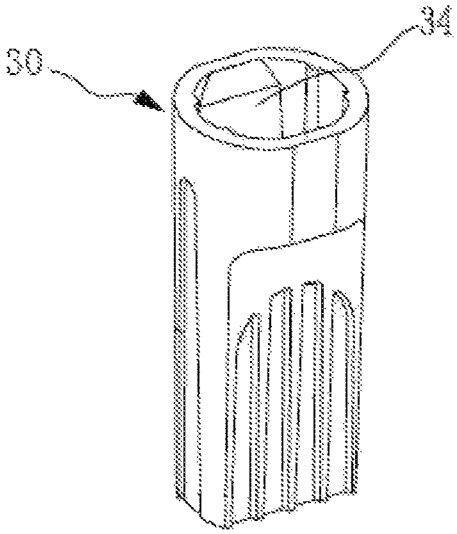
Fig. 14 (Prior art)
FIG. 14 is a perspective view of a connecting base of the conventional string lamp.

Referring to FIG. 12, FIG. 13 and FIG. 14, each lamp body 11 of the string lamp comprises a lamp bulb 1, a lamp holder 2 used for containing the lower portion of the lamp bulb 1, and a hollow connecting base 30. Wherein, at least two lamp pins 112 extend out from the lower end of the lamp bulb 1, and generally, the lamp bulb 1 can be a tungsten lamp bulb or an LED lamp bulb. The lamp holder 2 has a containing part 23 for containing the lower portion of the lamp bulb 1, and the edge of the bottom of the reception is formed with a line hole 27 allowing the at least two lamp pins 112 to protrude from the bottom of the lamp holder 2. The connecting base 30 is used for containing the lamp holder 2 and the conductive element of the lead wire segment, the connecting base 30 is provided with an opening for the insertion of the conductive element in its bottom, and the edge in which the opening is formed is provided with a clamping platform 34 for preventing the disengagement of the conductive element after it enters the opening, wherein the conductive element is electrically contacted with the corresponding lamp pin. The specific shape and structure of lamp body can be found by referring the Chinese patent No. CN201320549905.5, filed on Sep. 5, 2013 or the Chinese patent No. CN201320449870.8, filed on Jul. 26, 2013, both of which will not be described in detail herein.

The single-line string lamp of the present invention is characterized in that, in order to enhance the anti-tensile strength of each lead wire segment to stabilize the relative position of the conductive element and the inner wall of the connecting base, each lead wire segment is provided with a lead wire reinforcing object, or each lead wire segment adopts the connecting lead wire which can enhance its anti-tensile strength.

Figure 3:
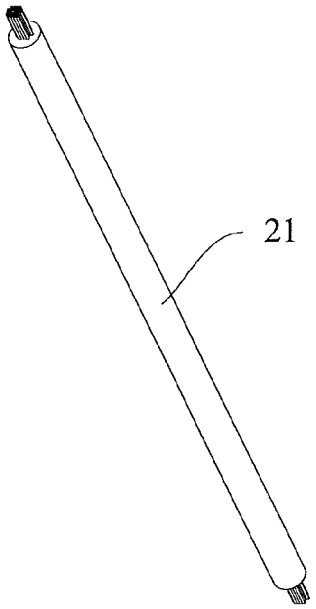
FIG. 3 is a structural schematic diagram of a lead wire used in a lead wire segment in one embodiment of the present invention.

Wherein, the particular embodiment is described as follows: in one example, as shown in FIG. 3, if a stronger anti-tensile force is required, one or more metal wires made from materials different from copper can be mixed in the conductive copper wire strand of the electrical line in use, such as, an iron wire, and the like, or at least one plastic wire or fiber wire contained is used to enhance the anti-tensile strength of the electrical line. As should be understood that, in this embodiment, the lead wire reinforcing object can be a metal wire, a plastic wire, a fiber wire, and the like that is made from materials different from the copper. In another example, the plastic coating of each lead wire segment may be adjusted into a thickness thicker than that of the standard electrical line with a diameter of 2.35 mm according to the U.S. standard by 0.2-2 mm, which will also enhance the anti-tensile strength of the lead wire segment. Accordingly, a better effect will be obtained by adding the metal wire different from the copper material, such as an iron wire, into the conductive copper wire strand as well as covering the conductive copper wire strand with a thickened plastic coating.

Figure 4:
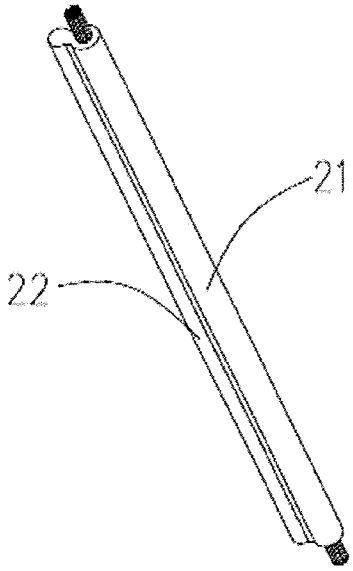
FIG. 4 is another structural schematic diagram of the lead wire used in the lead wire segment in one embodiment of the present invention.

In yet another example, as illustrated in FIG. 4, a plastic strip 22 integrally extends out from the outer side wall of the plastic coating 21 of the lead wire segment and extends along the side wall of the plastic coating 21. As the wire is connected with the conductive element, one end of the conductive element is tightly held outside the plastic coating 21 and the plastic strip 22, so that the anti-tensile strength is enhanced as a result of withstanding the tensile force together. Compared with the double-stranded line, this can be manufactured in a much simpler process.

In addition, if the anti-tensile force required is not so stronger, the connecting wire used in each lead wire segment can be a conventional electrical line or the electrical line conforming to the national or international standard, for example, using the UL conventional electrical line No. 22 or No. 20, or directly adopting the unconventional electrical line with a diameter of 2.0-3.0 mm.

As one preferred embodiment, in the present invention, if the lead wire segment is subjected to an outward tensile force with respect to the connecting base, in particular a transversal tensile force, a fixed part can be fixed at the position on the lead wire segment near the conductive element, in order to further ensure the stability of the relative position of the conductive element and the inner wall of the connecting base.

In a preferred embodiment, the fixed part is a fixed part that fixes the portions, adjacent to the conductive element (preferably immediately adjacent to the lower end of the conductive element, i.e. adjacent to the end of the conductive element away from the lamp bulb), of the lead wire segment connects the lower portion of each lamp body. The fixed part can be arranged either outside or inside the connecting base. When the fixed part is arranged inside the connecting base, the bottom of the fixed part abuts against the clamping platform. When the fixed part is arranged outside the opening of the connecting base, the upper portion of the fixed part is next to preferably the opening adjacent to the connecting base. The fixed part may be made of a material that has certain hardness, is deformable but free from damages under extrusion, and does not automatically restore its original shape even used for a long time after deformation, for example, but not limited to, a hard plastic part, such as, an intact plastic sleeve (plastic tube), a plastic sleeve having a gap or two plastic sheets connected at the middle portion. The fixed part may also be a metal part having certain hardness, for example, an intact metal sleeve (or known as metal tube, such as an iron ring, a copper ring, an alloy ring or a thick aluminum ring), a metal sleeve having a gap or two metal sheets connected at the middle portion. The fixed part may also be an above metal part sleeved with a plastic part outside. The fixed part may also be a hot-melt rubber sheath. When the lead wire segment is subjected to a transversal tensile force, the tensile force is acted on the end of the fixed part away from the conductive element, and will not be transferred onto the conductive element, such that the conductive element will substantially not interact with the clamping platform supporting the conductive element or the fixed part, and thus will not be pulled out. When the lead wire segment is subjected to a longitudinal (parallel to the direction in which the lamp bulb, the lamp holder and the connecting base are assembled) tensile force between the transversal direction and the longitudinal direction, two lead wire segments that are fixed together will be subject to the force together, which is to say, the two conductive elements are subject to the force together, which increases its anti-tensile capability. Yet, since the fixed part closely abuts against the connecting base, the tensile force is largely absorbed by the fixed part and the connecting base, and the part transferred onto the conductive element is extraordinarily small, so that the relative position between the conductive element and the inner wall of the connecting base will remain stable, and thus the conductive element will not be pulled out from the bottom of the connecting base.

Figure 5:
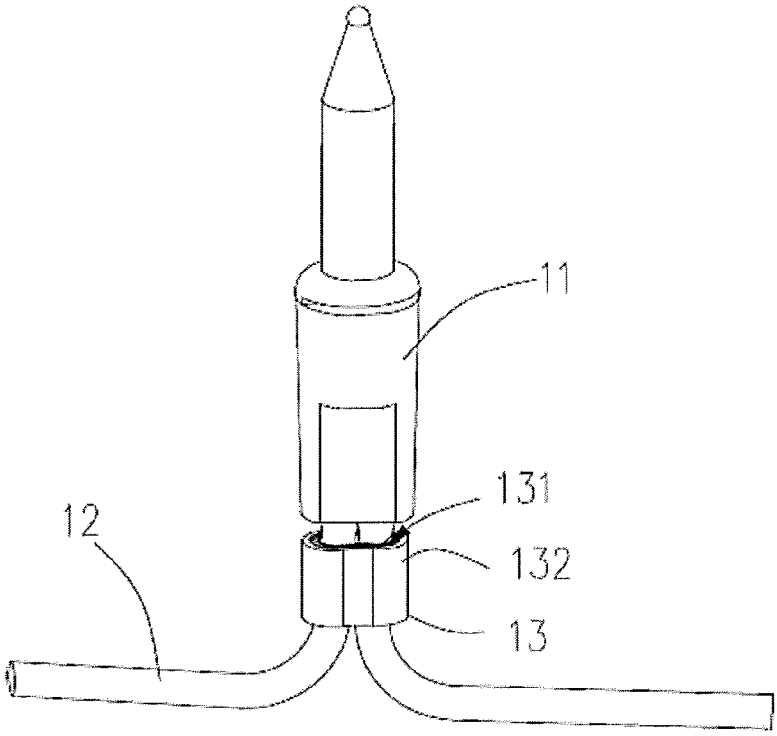
FIG. 5 is a structural schematic diagram of a single-line string lamp in one embodiment of the present invention, with a fixed part being fixed outside a lamp body.

As shown in FIG. 5, in one embodiment, each lamp body 11 of a single-line string lamp is connected with two lead wire segments 12. The fixed part 13 comprises a metal part 131 and a plastic part 132 sleeved on the metal part 131. The metal part 131 and the plastic part 132 are both in tubular shape, i.e. in a shape of a metal tube (or a metal sleeve) and a plastic sleeve. The fixed part 13 is fixed on a position of the two lead wire segments 12 adjacent to the lower portion of the lamp body. The positions of the metal sleeve 131 and the plastic sleeve 132 relative to the gap between the two lead wire segments are recessed towards the gap between the lead wire segments, so as to tightly clamp the two lead wire segments 12. During the actual assembly process, the fixed part 13 is firstly sleeved on the ends of the two lead wire segments 12, then the conductive element is inserted into the connecting base through the opening at the bottom of the lamp body 11, and finally the fixed part 13 is extruded by a tool until the position thereof relative to the gap between the two lead wire segments is recessed towards the gap between the lead wire segments.

In one variant embodiment of the single-line string lamp shown in FIG. 5, a plastic part having certain strength, deforming for extrusion and not prone to restore can be substituted for the combination of the metal part 131 and the plastic part 132 described above.

Figure 6:
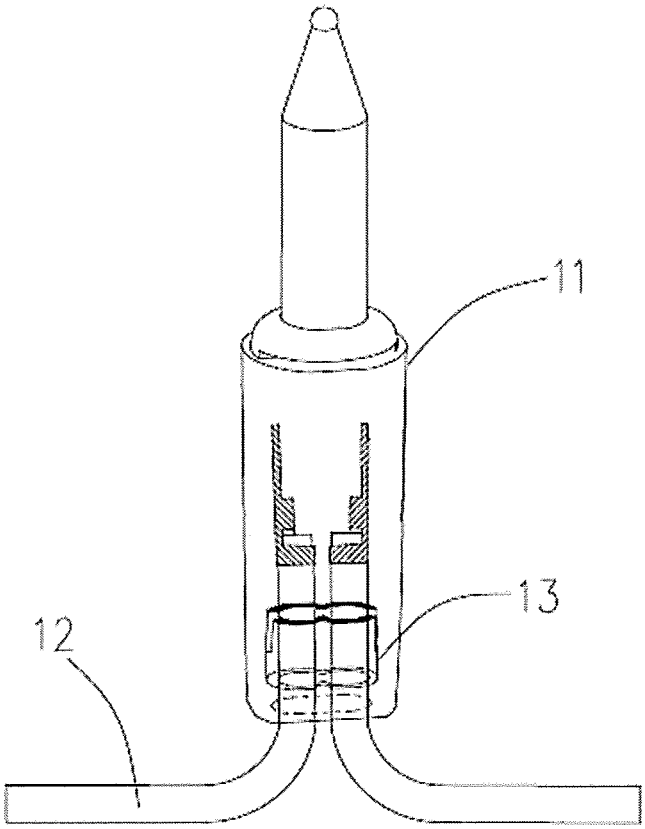
FIG. 6 is a structural schematic diagram of a single-line string lamp in another embodiment of the present invention, with a fixed part being fixed inside a lamp body.

In another variant embodiment the single-line string lamp shown in FIG. 5, the fixed part 13 can be arranged inside the connecting base, as shown in FIG. 6. During assembly, the fixed part 13 is inserted into the connecting base from the upper portion of the connecting base in advance and is pushed to the bottom, then the lead wire segment fixed with the conductive element is inserted from the bottom of the connecting base allowing the conductive element to extend from the upper end of the fixed part, and finally, the lower portion of the connecting base is extruded by a tool until the connecting base and the fixed part are entirely flattened or recessed at the middle part to extrude the lead wire segments.

In another embodiment, the fixed part may comprise a metal sleeve having a gap and a plastic sleeve having a gap and sleeved on the metal sleeve, wherein the two gaps are opposite to each other, and are also opposite to the gap between the two lead wire segments. During the assembly process, the fixed part is extruded by a tool, so that the portions on the metal sleeve and the plastic sleeve adjacent to their gaps bend towards the two lead wire segments (namely recessed inward), and the other opposite side is also recessed inward to closely clamp the two lead wire segments. In a variant embodiment, a plastic sleeve with gap that has certain strength, deforms for extrusion and is not prone to restore can be substituted for the combination of the metal part and the plastic part with gap. The fixed part of this structure can be arranged outside or inside the connecting seat.

During the assembly process, if extrusion-deformed tube type or sheath type is needed for fixing the parts, the internal diameter of the tube or sheath is preferably 4.7-5 mm, so that there is redundancy when being inserted into the lead wire segment, thus it is easy to operate.

In yet another embodiment, the fixed part may be two metal sheets or plastic sheets connected to each other at the middle portions. The fixed part is substantially in an "I" shape. During the assembly process, two ends of the metal sheets or the plastic sheets bend towards the lead wire segments to closely clamp the two lead wire segments.

Figure 7:
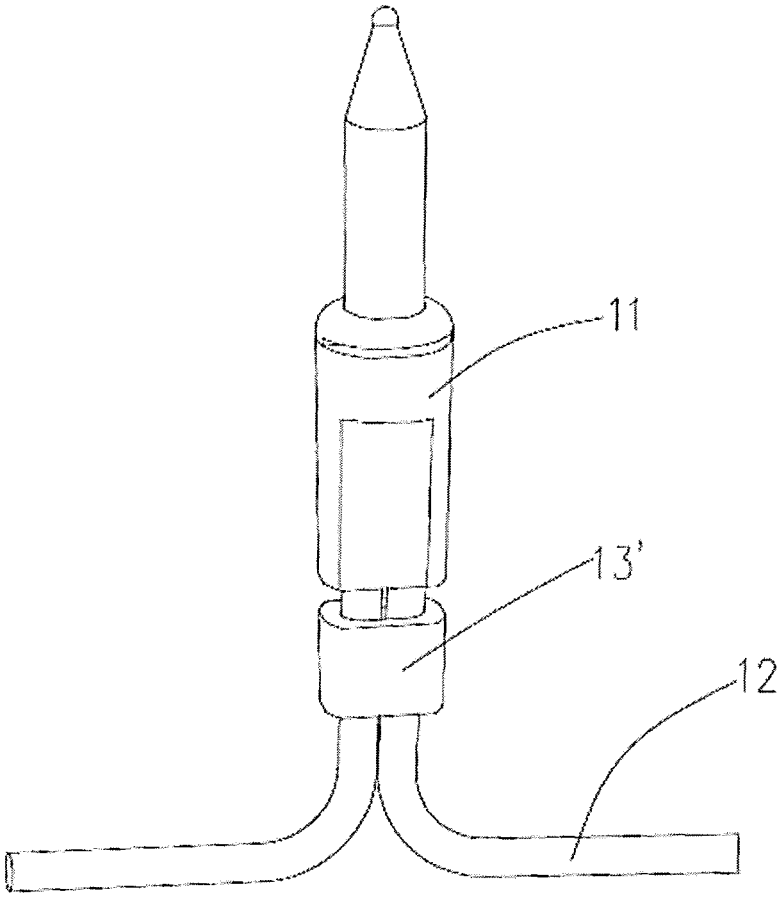
FIG. 7 is a structural schematic diagram of a single-line string lamp in yet another embodiment of the present invention, with a fixed part having a structure different from that of a fixed part of a single-line string lamp in FIG. 3.

In another embodiment, as shown in FIG. 7, each lamp body 11 is connected with two lead wire segments 12. The fixed part 13' is a hot-melt plastic sleeve. The hot-melt plastic sleeve is tightly sleeved on the position of the two lead wire segments adjacent to the conductive element. In the embodiment, the hot-melt plastic sleeve is arranged outside the lamp body. In a variant embodiment, the hot-melt plastic sleeve can be arranged inside the lamp body, preferably, with wall thickness larger than the width of the clamping platform, so that the outward tensile force is absorbed, and the relative position of the conductive device and the inner wall of the connecting base is retained.

Figure 8:
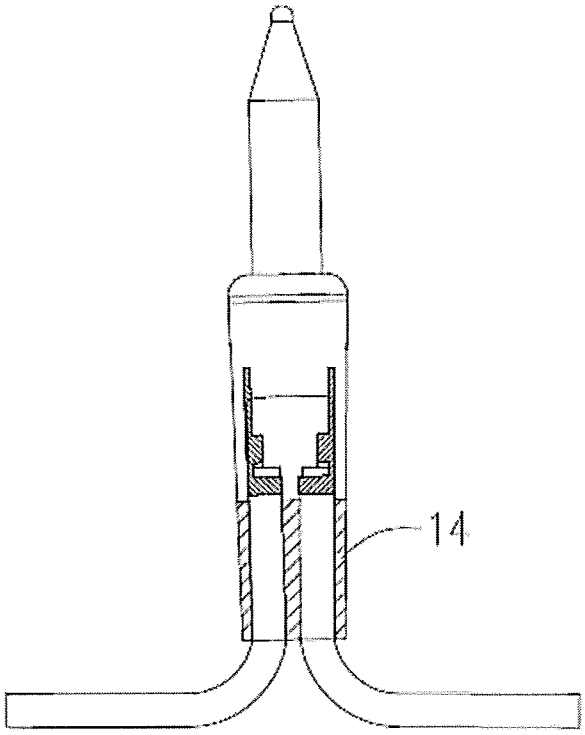
FIG. 8 is a structural schematic diagram of a single-line string lamp in one embodiment of the present invention, with glue being filled in the lower portion of the lamp body as a fixed part.

In yet another embodiment, as shown in FIG. 8, the fixed part is glue 14 filled between the lead wire segment extending into the connecting base and the inner wall of the connecting base. And preferably, the height of the glue from the bottom of the connecting base to the top of the connecting base is at least 4 mm, the bottom of the conductive element abuts against the top of the cured glue, and the cured glue and the lower part of the connecting base are connected integrally, so as to ensure the tensile force is wholly absorbed and born, thus to retain the relative position between the conductive element and the inner wall of the connecting base.

In another embodiment, with the fixed part being arranged inside the connecting base, when the lead wire segment is subjected to the lateral tensile force, the force bearing point of the lead wire segment can be far away from the fixed part of the conductive element, as a result of which, the force transferred to the conductive element is reduced, and the conductive element is slightly inclined from the inner wall of the connecting base. And since the fixed part is arranged inside the connecting base, the frictional and connecting forces between the clamping platform of the connecting base and the lead wire segments are enhanced, so that the conductive element is less prone to be disengaged from the connecting base.

Figure 9:
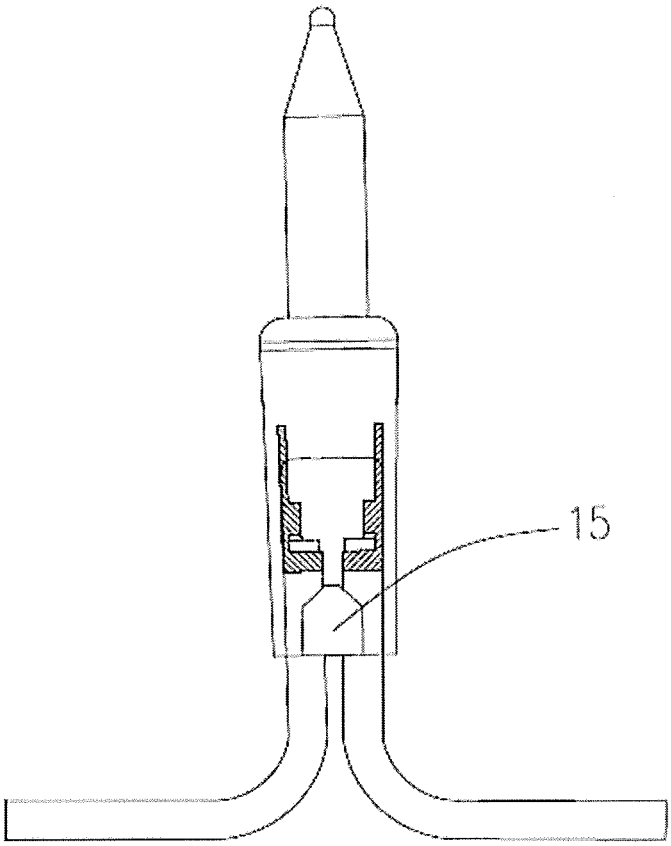
FIG. 9 is a structural schematic diagram of a single-line string lamp in another embodiment of the present invention, wherein a fixed part is a plastic plug.

In one embodiment, as shown in FIG. 9, the fixed part is a plastic part 15 inserted into the space between the lead wire segments from the opening at the bottom of the connecting base, and the bottom of the conductive element is adjacent to the top of the plastic part. The plastic part 15 is in a rail shape with the front end shrunk, wherein the side face facing towards the sidewall of the lead wire segment is formed with a groove for extruding the lead wire segment onto the inner sidewall of the connecting base, to increase the friction force between the lead wire segments and the connecting base, to allow the force bearing point far away from the conductive element, in some sense to bundle the two lead wire segments together, and to cause the connecting base and the plastic part 15 to absorb the transversal tensile force of the lead wire segment from outside together with the lead wire segment. Preferably, the height of the plastic part 15 from the bottom to the top of the connecting base is at least 3 mm, so as to ensure a favorable effect.

Figure 10:
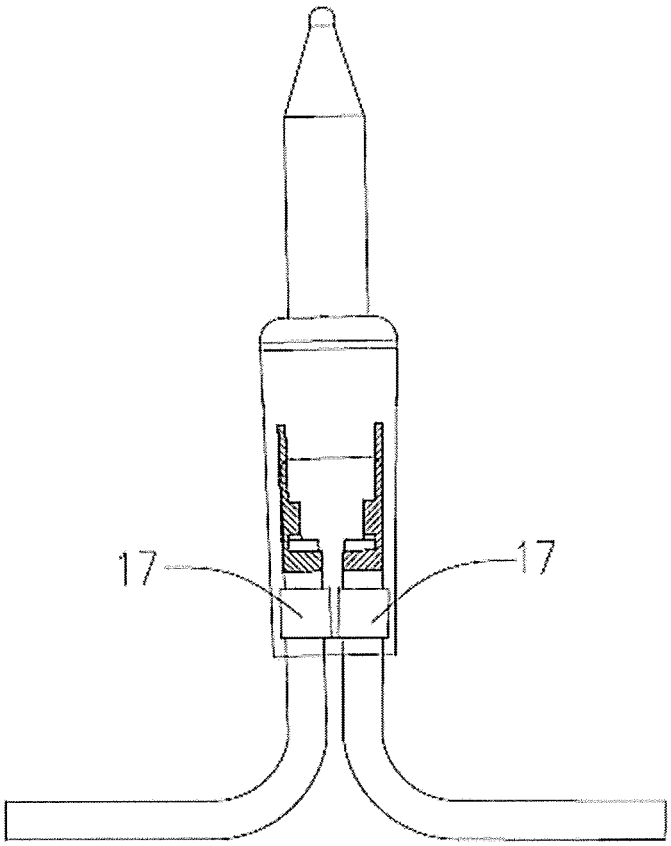
FIG. 10 is a structural schematic diagram of a single-line string lamp in yet another embodiment of the present invention, wherein a fixed part is fixed on each lead wire segment.

In another embodiment, as shown in FIG. 10, the embodiment is in fact a variant of the string lamp as shown in FIG. 4. The fixed part 17 may comprise a complete metal sleeve or a metal sleeve with a gap sleeved on each lead wire segment, or a U-shaped metal sheet clamped on each lead wire segment. The fixed part is arranged within a connecting base, abuts against a clamping platform of the connecting base, and is adjacent to the corresponding conductive element. During assembling, the lower portion of the connecting base is clamped by a tool, so that the lead wire segment is tightly clamped by the fixed part and the fixed part is tightly clamped by the connecting base. Accordingly, as the tension occurs, the force bearing point is allowed to be far from the conductive element, and the force from the outer lead wire segment is absorbed by both the connecting base and the fixed part 17. In the embodiment, the two lead wire segments are bundled together in some sense, so that the lateral tensile force from the outer lead wire segment is absorbed by the connecting base and the fixed part together with the lead wire segment, to prevent the conductive device from being pulled out.

Figure 11:
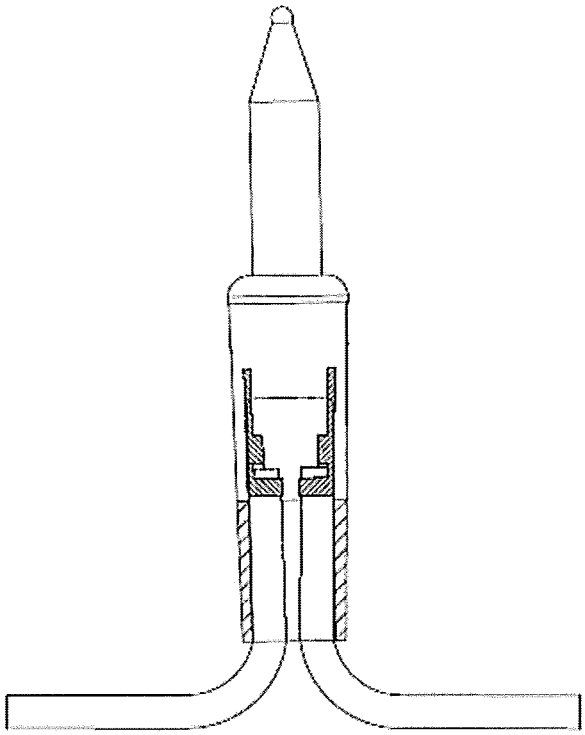
FIG. 11 is a structural schematic diagram of a single-line string lamp in still another embodiment of the present invention, wherein a fixed part is a lengthened clamping platform.

In yet another embodiment, as shown in FIG. 11, the fixed part is an extension part formed by the clamping platform of the connecting base extending to the top of the connecting base by at least 4 mm along the inner sidewall of the connecting base. Preferably, the extension part is connected with the inner wall of the connecting base, and its top is abutted against by the bottom of the conductive element. From a different perspective, the clamping platform of the connector holder is heightened and part of the inner wall at the bottom of the connecting base is thickened. Thus, when the lead wire segment is subjected to the lateral tensile force, the transverse component of the lateral tensile force is mostly absorbed by the clamping platform and the fixed part, and part of the transverse component is transferred to the conductive element through a conducting wire of at least 4 mm, so that most of the force is converted into vertical pull force, the relative position of the conductive element and the inner sidewall of the connecting part only has small variation, and the conductive device will not be pulled out from the bottom of the connecting base. In addition, the copper sheet of the conductive element is preferably thickened to above 0.24 mm, as a result, the contact area with the fixed part is increased, the anti-tensile force is enhanced, and the conductive element is difficult to be pulled out.

The present invention provides another single-line string lamp. In order to reinforce the stability of the single-line string lamp, generally the single-line string lamp can be mainly arranged on the supports of Christmas trees, Christmas canes or Christmas wreath branches and leaves, and the electrical line used in the lead wire segment connected to each lamp body can be fixed on the corresponding branches and supports in a winding or plastic clamping manner.

To sum up, when the single-line string lamp of the present invention is subjected to a lateral tensile force, the conductive element will not be separated from the opening at the bottom of the connecting base, so as to ensure the normal operation of the string lamp. Therefore, only one lead wire segment is needed for the connection between the lamp bodies, without arranging a false line to bear most of lateral tension.

Although the present invention has been described in conjunction with specific embodiments thereof, it is evident that many alternatives, modifications and variations will be apparent to those skilled in the art. All such substitutes, modifications and changes are deemed to be within the spirit and scope of the present invention as it is set out in the following claims.

I claim:

1. A single-line string lamp, comprising a plurality of lamp bodies connected in series and a plurality of lead wire segments used for connecting two adjacent lamp bodies or connecting the lamp bodies with power connectors; a conductive element being fixed at an end, which is connected with a corresponding lamp body, of each lead wire segment; and each lamp body comprising: a lamp bulb, a lower end of which extends out of at least two lamp pins; a lamp holder, comprising a containing part used for containing a lower portion of the lamp bulb, line holes for the at least two lamp pins to extend out of a bottom of the lamp holder being formed in an edge of the bottom of a containing part; and a hollow connecting base, used for containing the lamp holder, an opening for the conductive element to enter being formed in a bottom of the hollow connecting base, an edge, in which the opening is formed, being provided with a clamping platform for preventing the conductive element from being disengaged after the conductive element enters the opening, and the conductive element being in electrical contact with a corresponding lamp pin; wherein each lead wire segment is provided with a lead wire reinforcing object used for enhancing anti-tensile strength, or a connecting lead wire with enhanced anti-tensile strength is adopted in each lead wire segment;

wherein a fixed part is fixed at a position on each lead wire segment close to a corresponding conductive element, and when each lead wire segment is subjected to an outward tensile force relative to each corresponding connecting base, relative positional stability between the corresponding conductive element and an inner wall of the corresponding connecting base is maintained by each fixed part; and wherein each lamp body is connected with two lead wire segments, the fixed part comprises a plastic part, and the plastic part is tightly fixed at a position on the two lead wire segments close to the conductive element, so as to fix the two lead wire segments together; and the plastic part is one of: a complete plastic sleeve, a plastic sleeve with a gap, and two plastic sheets with central portions being connected together.

2. The single-line string lamp according to claim 1, wherein an electrical line used in each lead wire segment is an electrical line internally provided with at least one wire made from plastic materials or fiber filament.

3. The single-line string lamp according to claim 1, wherein a thickness of a plastic coating of each lead wire segment is 0.2-2 mm greater than a thickness of a standard electrical line with a diameter of 2.35 mm in the U.S. standard.

4. The single-line string lamp according to claim 1, wherein a metal wire different from a copper material is mixed in a conductive copper wire strand of each lead wire segment.

5. The single-line string lamp according to claim 1, wherein a plastic strip which extends along a side wall of a corresponding plastic coating integrally extends out of an outer side wall of the corresponding plastic coating of each lead wire segment, and one end of each conductive element is tightly held outside the corresponding plastic coating of each lead wire segment and the plastic strip.

6. The single-line string lamp according to claim 1, wherein the connecting lead wire used in each lead wire segment is a UL conventional electrical line No. 22 or No. 20.

7. The single-line string lamp according to claim 1, wherein the connecting lead wire used in each lead wire segment is a non-conventional electrical line with a diameter of 2.0-3.0 mm.

8. The single-line string lamp according to claim 1, wherein when the plastic part is a complete plastic sleeve, a recess facing a gap between the two lead wire segments is formed in a position on the plastic part opposite to the gap, so as to tightly clamp the two lead wire segments; when the plastic part is a plastic sleeve with a gap, the gap is opposite to the gap between the two lead wire segments, and a recess is formed to tightly clamp the two lead wire segments; and when the plastic part is two plastic sheets with central portions being connected together, two ends of the two plastic sheets are bent towards the lead wire segments to tightly clamp the two lead wire segments.

9. The single-line string lamp according to claim 1, wherein each lamp body is connected with two lead wire segments, and the fixed part comprises a metal part and a plastic part sleeved on the metal part; the fixed part is fixed at a position on the two lead wire segments close to the conductive element; the metal part and the plastic part are one of: (1) a complete metal sleeve and a complete plastic sleeve sleeved on the complete metal sleeve, (2) a metal sleeve with a gap and a plastic sleeve with a gap sleeved on the metal sleeve, and (3) two metal sheets or plastic sheets with central portions being connected together; when the fixed part is a complete metal sleeve and a complete plastic sleeve sleeved on the complete metal sleeve, a recess facing a gap between the lead wire segments is formed in a position on the complete metal sleeve and the complete plastic sleeve opposite to the gap between the two lead wire segments, so as to tightly clamp the two lead wire segments; when the fixed part is a metal sleeve with a gap and the plastic sleeve with a gap sleeved on the metal sleeve, the gap in the metal sleeve and the plastic sleeve is opposite to the gap between the two lead wire segments, and a recess is formed to tightly clamp the two lead wire segments; and when the fixed part is two metal sheets or plastic sheets with central portions being connected together, two ends of the two metal sheets are bent towards the lead wire segments to tightly clamp the two lead wire segments.

10. The single-line string lamp according to claim 1, wherein each lamp body is connected with at least two lead wire segments, the fixed part comprises a hot-melt plastic sleeve, and the hot-melt plastic sleeve is tightly sleeved at a position on the two lead wire segments close to the conductive element.

11. The single-line string lamp according to claim 1, wherein the fixed part is arranged at one of the following two positions: (1) the fixed part is arranged in the connecting base, and props against the clamping platform; and (2) the fixed part is arranged outside an opening of the connecting base, and is close to the opening of the connecting base.

12. The single-line string lamp according to claim 1, wherein the fixed part comprises a complete metal sleeve or a metal sleeve with a gap sleeved on each lead wire segment, or comprises a U-shaped metal sheet clamped on each lead wire segment, and the fixed part is arranged in the connecting base, props against the clamping platform, and is close to the corresponding conductive element.

13. The single-line string lamp according to claim 1, wherein the fixed part is an extension part, which extends towards a top of the connecting base for at least 4 mm, of the clamping platform, the extension part is connected with the inner wall of the connecting base, and a bottom of the conductive element props against the top of the extension part.

14. The single-line string lamp according to claim 1, wherein the fixed part is glue filled between the lead wire segment extending into the connecting base and the inner wall of the connecting base, a height of the glue in a direction from a bottom of the connecting base to a top of the connecting base is at least 4 mm, and a bottom of the conductive element props against the top of the fixed part.

15. The single-line string lamp according to claim 1, wherein the fixed part is a plastic part which is inserted into a gap between the lead wire segments from the opening in the connecting base, the lead wire segments are tightly extruded towards a side wall of the connecting base by the plastic part, a bottom of the conductive element is close to a top of the plastic part, and a height of the plastic part in a direction from a bottom of the connecting base to a top of the connecting base is at least 3 mm.

16. The single-line string lamp according to claim 1, wherein the single-line string lamp is distributed on Christmas trees, Christmas canes or Christmas wreath branches and leaves.

17. The single-line string lamp according to claim 1, wherein an electrical line used in the lead wire segment connected on each lamp body is fixed on a corresponding branch and leaf or bracket respectively by means of winding or clamping with plastics.

* * * * *